US007090734B2

(12) United States Patent
Aster et al.

(10) Patent No.: US 7,090,734 B2
(45) Date of Patent: Aug. 15, 2006

(54) DISPENSER FOR CONTINUOUSLY AND DISCONTINUOUSLY DISPENSING MATERIAL COMPOSED OF DOUBLE-SIDEDLY SELF-ADHESIVE CARRIER MATERIAL ON A REEL

(75) Inventors: Günther Aster, Hamburg (DE); Bernhard Gebbeken, Hamburg (DE); Gerd Hebbel, Hamburg (DE); Reiner Schulze, Hamburg (DE)

(73) Assignee: tesa Aktiengesellschaft, Hamburg (DE)

( * ) Notice: Subject to any disclaimer, the term of this patent is extended or adjusted under 35 U.S.C. 154(b) by 0 days.

(21) Appl. No.: 10/164,796

(22) Filed: Jun. 7, 2002

(65) Prior Publication Data

US 2003/0056903 A1 Mar. 27, 2003

(30) Foreign Application Priority Data

Sep. 27, 2001 (DE) ..... 101 47 813

(51) Int. Cl.
*B32B 37/00* (2006.01)

(52) U.S. Cl. ..... 156/64; 156/269; 156/351; 156/354; 156/355; 156/521; 156/540

(58) Field of Classification Search ..... 156/351, 156/353, 354, 350, 358, 361, 366, 519, 521, 156/522, 540, 541, 543, 355, 64, 269, 270
See application file for complete search history.

(56) References Cited

U.S. PATENT DOCUMENTS

| | | | | |
|---|---|---|---|---|
| 2,776,068 | A * | 1/1957 | Johnson | 156/351 |
| 3,751,324 | A * | 8/1973 | Enskat | 156/521 |
| 3,765,992 | A * | 10/1973 | Stageberg | 156/521 |
| 3,955,481 | A * | 5/1976 | Heitmann | 493/8 |
| 4,026,754 | A * | 5/1977 | Bogdanski et al. | 156/521 |
| 4,379,017 | A | 4/1983 | Barta | 156/238 |
| 4,622,260 | A | 11/1986 | Tesch | 428/173 |
| 4,636,276 | A * | 1/1987 | Nozaka | 156/353 |
| 4,844,962 | A | 7/1989 | May et al. | 428/43 |
| 5,076,878 | A | 12/1991 | McLees et al. | 156/353 |
| 5,112,427 | A * | 5/1992 | Bekker-Madsen | 156/259 |

FOREIGN PATENT DOCUMENTS

| | | |
|---|---|---|
| DE | 91 02 456.0 | 3/1991 |
| DE | 43 13 008 C1 | 10/1994 |
| DE | 42 15 947 C2 | 8/1997 |
| EP | 0 071 212 B1 | 9/1983 |
| EP | 0 121 371 A1 | 10/1984 |
| EP | 0 578 151 A1 | 12/1994 |
| EP | 0 755 890 A1 | 5/1997 |
| WO | WO 95/05927 | 3/1995 |

OTHER PUBLICATIONS

U.S. Appl. No. 08/847,395 as English language counterpart of DE 43 13 008 C1.

* cited by examiner

*Primary Examiner*—James Sells
(74) *Attorney, Agent, or Firm*—Norris McLaughlin & Marcus PA

(57) ABSTRACT

A dispenser for dispensing double-sided adhesive tape, from a reel, comprising a press for pressing the tape onto a product, a cutter which guides the tape and makes an incision in the tape and a controller for controlling the application of the tape to the product.

12 Claims, 8 Drawing Sheets

DISPENSER FOR CONTINUOUSLY AND DISCONTINUOUSLY DISPENSING MATERIAL COMPOSED OF DOUBLE-SIDEDLY SELF-ADHESIVE CARRIER MATERIAL ON A REEL

The invention relates to a dispenser by means of which material composed of double-sided self-adhesive carrier material on a reel can be dispensed.

BACKGROUND OF THE INVENTION

For unwinding double-sidedly self-adhesive material on a reel there are a large number of unwinders which are tailored to the particular material, whether it be a narrow or else, possibly, wide adhesive tape or a wide adhesive sheet.

By way of example, EP 0 121 371 A1 discloses an apparatus which is used for placing a double-sided adhesive tape on packaging for cigarettes, inter alia. The apparatus comprises a means for moving the packaging material and a dispenser for supplying the adhesive strip to a location where it is to be brought into contact with the moving packaging material. The dispenser comprises a frame carrying

- a support means for receiving a rotatable reel of the adhesive tape,
- a guide means defining a tape path from the reel to said location,
- a brake means, and
- a drive means.

The guide means is formed in turn by a fixed guide member and also a second guide member, which is mounted for a pivotal movement around a pin, in order to be movable relatively within the tape path in accordance with changes in the tension of the tape. Extending between the members are a tension spring and a slidable balance weight, which is carried by the second guide member and is adjustable so that the second guide member is in equilibrium about the pin.

The brake means is provided in order to reduce the rotational speed of the reel and is controlled by the relative motion of the members, whereby the brake means is released as the tension in the tape increases and applied when the tension in the tape decreases. The drive means serves for forced drive of the reel and so produces a rotational speed which becomes greater in dependence on an increase in the tension of the tape moving along said path.

In the papermaking industry, the finished paper is wound onto reels some of which are up to eight meters in width.

At the interior of the reels there is a core or sleeve, usually of cardboard, which at the beginning gives the reel the necessary stability in order to allow the winding operation. The winding operation starts by the application to the core in the longitudinal direction of a strip of adhesive, the beginning of the paper being fixed to this strip and thus to the core. The adhesive is normally a hotmelt adhesive, which is applied automatically in appropriate width by way of a nozzle, which for that purpose is caused to travel over the core in the longitudinal direction.

Since the plant and apparatus for processing hotmelt adhesive is complex and susceptible to faults, attempts have been made to replace the hotmelt adhesive by double-sided adhesive tapes.

To date, these adhesive tapes have normally been dispensed onto the core by hand using a manual unwinder adapted appropriately to the adhesive tape.

SUMMARY OF THE INVENTION

It is an object of the invention to provide a dispenser which, while being of very simple constructional design, allows and at the same time alternates an operation of dispensing adhesive tapes onto sleeves or cores, and which avoids or at least reduces the known disadvantages of the prior art.

The present invention provides a dispenser for dispensing material composed of a double-sidedly self-adhesive carrier material on a reel itself, which comprises

- a pressure-exerting means, especially pressure roller, which during the dispensing operation presses the material to be dispensed onto the product running beneath the pressure-exerting means, especially pressure roller, and is otherwise in a rest position above the product,
- a cutting means, via which the material is guided in the direction of the pressure-exerting means, especially pressure roller, said cutting means being arranged upstream of the pressure-exerting means, especially pressure roller, and weakening the material by means of an incision during the cutting operation,
- a means of recognizing the position of the product guided to the dispenser, comprising at least
  - a) a start contact which, when the product is passed in front of it, triggers the dispensing operation of the dispenser so that the pressure-exerting means, especially pressure roller, is guided out of the rest position into the dispensing position,
  - b) an end contact which, when the product is passed in front of it, ends the dispensing operation of the dispenser, so that the pressure-exerting means, especially pressure roller, is guided out of the dispensing position into the rest position, and if desired
  - c) a blade contact which, when the product is passed in front of it, initiates the cutting operation of the cutting means.

DETAILED DESCRIPTION

It is particularly preferred if the pressure-exerting means is configured as a pressure roller. Besides this embodiment, other designs are possible. Thus the pressure-exerting means may be designed in the form of a brush or plate.

The blade contact is preferably a single contact. Alternatively, it may be integrated in the start contact or in the end contact. Particularly when the distance of the blade roller from the pressure roller corresponds to the length of the material which is dispensed onto the product, blade contact and start contact may be integrated in a single contact.

In one preferred embodiment of the dispenser the cutting means is composed of a blade roller and a counterroller, the blade roller being composed of a roller on which there is at least one blade in the longitudinal direction.

Here again, other embodiments are possible, for example, the requisite cut may be applied not by a blade with blade roller but instead by a punch or punching line.

In achievement of the object of the invention, in a further advantageous embodiment downstream of the pressure roller in the dispenser there is a fixing roller which presses the dispensed material onto the product, the fixing roller preferably being adapted to the surface form of the product.

As in the case of the pressure-exerting means, the fixing roller may also be designed in the form of a brush or plate.

If the sleeve or the core which is guided as a product into the dispenser has a diameter which is large in comparison to the width of the adhesive tape to be dispensed, the core is only very slightly curved in the region in which the adhesive tape is applied.

In this case it is sufficient if the fixing roller is of cylindrical shape, especially if, in a further advantageous embodiment, the fixing roller is provided with an external rubber covering or is manufactured entirely of rubber. The fixing roller is in that case sufficiently flexible that it presses the adhesive tape over its full area onto the product, since it is a able to compensate for the slight surface curvature of the product.

If the sleeve or the core which is guided as a product into the dispenser has a diameter which is small in comparison to the width of the adhesive tape to be dispensed, the core is sharply curved in the region in which the adhesive tape is applied.

In this case it is advantageous if the running area of the fixing roller is concave in shape, in order to compensate for the curvature of the surface of the product by an appropriately designed opposite curvature, so that in this case as well the adhesive tape is securely pressed over its full area. Expressed in mathematical terms, the fixing roller adopts the form of a one-sheeted rotational hyperboloid. Again, preferably, the fixing roller is provided with an outer rubber covering or is manufactured entirely of rubber.

When wound up into an Archimedean spiral, double-sided adhesive tapes normally have a continuous release paper between the individual winds on the reel. Said release paper is placed onto one of the two adhesive sides of the adhesive tape before the adhesive tape is wound onto the reel.

If, then, the dispenser is employed in conjunction with such an adhesive tape, it is advantageous if downstream of the pressure roller there is a storage roller which winds up the release paper of the dispensed material.

Alternatively, the release paper can be led off by means of an appropriately designed suction system, with a suction strip or an induced draft, for example.

With preference the looping angle of the material on the pressure roller is 180°.

With particular advantage, the contacts in the dispenser that are required for initiating particular operations are, for example, switching elements such as light barriers, air barriers, touch levers, and similar means known to the skilled worker for the purpose of initiating a (switching) operation.

It is likewise within the context of the invention for the contacts to be designed in the form of path measurement systems; that is, if the cores are guided by a defined distance into the dispenser, which initiates the start contact, which when the product is passed in front of it initiates the dispensing operation of the dispenser, so that the pressure-exerting means, especially pressure roller, is guided out of the rest position into the dispensing position.

The core is then advanced a further defined distance, which in turn initiates the end contact.

The blade contact as well, where present, can be initiated by way of distance traversed by the core.

As carrier material it is possible to use all known textile carriers such as wovens, knits or nonwoven webs; the term "web" embraces at least textile sheetlike structures in accordance with EN 29092 (1988) and also stitchbonded nonwovens and similar systems.

It is likewise possible to use spacer fabrics, including wovens and knits, with lamination. Spacer fabrics of this kind are disclosed in EP 0 071 212 B1. Spacer fabrics are matlike layer structures comprising a cover layer of a fiber or filament fleece, an underlayer and individual retaining fibers or bundles of such fibers between these layers, said fibers being distributed over the area of the layer structure, being needled through the particle layer, and joining the cover layer and the underlayer to one another. As an additional though not mandatory feature, the retaining fibers in accordance with EP 0 071 212 B1 comprise inert mineral particles, such as sand, gravel or the like, for example.

The holding fibers needled through the particle layer hold the cover layer and the underlayer at a distance from one another and are joined to the cover layer and the underlayer.

Spacer wovens or spacer knits are described, inter alia, in two articles, namely an article from the journal kettenwirk-praxis 3/93, 1993, pages 59 to 63, "Raschelgewirkte Abstandsgewirke" [Raschel-knitted spacer knits]

and an article from the journal keftenwirk-praxis 1/94, 1994, pages 73 to 76, "Raschelgewirkte Abstandsgewirke", the content of said articles being included here by reference and being part of this disclosure and invention.

Knitted fabrics are produced from one or more threads or thread systems by intermeshing (interlooping), in contrast to woven fabrics, which are produced by intersecting two thread systems (warp and weft threads), and nonwovens (bonded fiber fabrics), where a loose fiber web is consolidated by heat, needling or stitching or by means of water jets.

Knitted fabrics can be divided into weft knits, in which the threads run in transverse direction through the textile, and warp knits, where the threads run lengthwise through the textile. As a result of their mesh structure, knitted fabrics are fundamentally pliant, conforming textiles, since the meshes are able to stretch lengthways and widthways, and have a tendency to return to their original position. In high-grade material, they are very robust.

Suitable nonwovens include, in particular, consolidated staple fiber webs, but also filament webs, meltblown webs, and spunbonded webs, which generally require additional consolidation. Known consolidation methods for webs are mechanical, thermal, and chemical consolidation. Whereas with mechanical consolidations the fibers can be held together purely mechanically by entanglement of the individual fibers, by the interlooping of fiber bundles or by the stitching-in of additional threads, it is possible by thermal and by chemical techniques to obtain adhesive (with binder) or cohesive (binderless) fiber-fiber bonds. Given appropriate formulation and an appropriate process regime, these bonds may be restricted exclusively, or at least predominantly, to the fiber nodal points, so that a stable, three-dimensional network is formed while retaining the loose open structure in the web.

Webs which have proven particularly advantageous are those consolidated in particular by overstitching with separate threads or by interlooping.

Consolidated webs of this kind are produced, for example, on stitchbonding machines of the "Malifleece" type from the company Karl Mayer, formerly Malimo, and can be obtained, inter alia, from the companies Naue Fasertechnik and Techtex GmbH. A Malifleece is characterized in that a cross-laid web is consolidated by the formation of loops from fibers of the web.

The carrier used may also be a web of the Kunit or Multiknit type. A Kunit web is characterized in that it originates from the processing of a longitudinally oriented fiber web to form a sheetlike structure which has the heads and legs of loops on one side and, on the other, loop feet or pile fiber folds, but possesses neither threads nor prefabricated sheetlike structures. A web of this kind has been produced, inter alia, for many years, for example on stitchbonding machines of the "Kunitvlies" type from the company Karl Mayer. A further characterizing feature of this web is that, as a longitudinal-fiber web, it is able to absorb high tensile forces in the longitudinal direction. The characteristic feature of a Multiknit web relative to the Kunit is that the web is consolidated on both the top and bottom sides by virtue of the double-sided needle punching.

Finally, stitchbonded webs are also suitable as an intermediate forming an adhesive tape. A stitchbonded web is formed from a nonwoven material having a large number of stitches extending parallel to one another. These stitches are brought about by the incorporation, by stitching or knitting, of continuous textile threads. For this type of web, stitchbonding machines of the "Maliwatt" type from the company Karl Mayer, formerly Malimo, are known.

Also particularly advantageous is a staple fiber web which is mechanically preconsolidated in the first step or is a wet-laid web laid hydrodynamically, in which between 2% and 50% of the web fibers are fusible fibers, in particular between 5% and 40% of the fibers of the web.

A web of this kind is characterized in that the fibers are laid wet or, for example, a staple fiber web is preconsolidated by the formation of loops from fibers of the web or by needling, stitching or air-jet and/or water-jet treatment.

In a second step, thermofixing takes place, with the strength of the web being increased again by the (partial) melting of the fusible fibers.

The web carrier may also be consolidated without binders, by means for example of hot embossing with structured rollers, with properties such as strength, thickness, density, flexibility, and the like being controllable via the pressure, temperature, residence time, and embossing geometry.

For the use of nonwovens, the adhesive consolidation of mechanically preconsolidated or wet-laid webs is of particular interest, it being possible for said consolidation to take place by way of the addition of binder in solid, liquid, foamed or pastelike form. A great diversity of theoretical embodiments is possible: for example, solid binders as powders for trickling in; as a sheet or as a mesh, or in the form of binding fibers. Liquid binders may be applied as solutions in water or organic solvent or as a dispersion. For adhesive consolidation, binder dispersions are predominantly chosen: thermosets in the form of phenolic or melamine resin dispersions, elastomers as dispersions of natural or synthetic rubbers, or, usually, dispersions of thermoplastics such as acrylates, vinyl acetates, polyurethanes, styrene-butadiene systems, PVC, and the like, and also copolymers thereof. Normally, the dispersions are anionically or nonionically stabilized, although in certain cases cationic dispersions may also be of advantage.

The binder may be applied in a manner which is in accordance with the prior art and for which it is possible to consult, for example, standard works of coating or of nonwoven technology such as "Vliesstoffe" (Georg Thieme Verlag, Stuttgart, 1982) or "Textiltechnik-Vliesstofferzeugung" (Arbeitgeberkreis Gesamttextil, Eschborn, 1996).

For mechanically preconsolidated webs which already possess sufficient composite strength, the single-sided spray application of a binder is appropriate for effecting specific changes in the surface properties.

Such a procedure is not only sparing in its use of binder but also greatly reduces the energy requirement for drying. Since no squeeze rollers are required and the dispersion remains predominantly in the upper region of the web material, unwanted hardening and stiffening of the web can very largely be avoided.

For sufficient adhesive consolidation of the web carrier, the addition of binder in the order of magnitude of from 1% to 50%, in particular from 3% to 20%, based on the weight of fiber web, is generally required.

The binder may be added as early as during the manufacture of the web, in the course of mechanical preconsolidation, or else in a separate process step, which may be carried out in-line or off-line. Following the addition of the binder it is necessary temporarily to generate a condition in which the binder becomes adhesive and adhesively connects the fibers—this may be achieved during the drying, for example, of dispersions, or else by heating, with further possibilities for variation existing by way of a real or partial application of pressure. The binder may be activated in known drying tunnels, or else, given an appropriate selection of binder, by means of infrared radiation, UV radiation, ultrasound, high-frequency radiation or the like. For the subsequent end use it is sensible, although not absolutely necessary, for the binder to have lost its tack following the end of the web production process. It is advantageous that, as a result of the thermal treatment, volatile components such as fiber assistants are removed, giving a web having favorable fogging values so that when a low-fogging adhesive composition is used it is possible to produce an adhesive tape having particularly advantageous fogging values.

A further, special form of adhesive consolidation consists in activating the binder by incipient dissolution or swelling. In this case it is also possible in principle for the fibers themselves, or admixed special fibers, to take over the function of the binder. Since, however, such solvents are objectionable on environmental grounds, and/or are problematic in their handling, for the majority of polymeric fibers, this process is not often employed.

Starting materials envisaged for the textile carrier include, in particular, polyester, polypropylene, viscose or cotton fibers. The selection is, however, not restricted to said materials; rather it is possible to use a large number of other fibers to produce the web, this being evident to the skilled worker without any need for inventive activity.

Carrier materials used further include, in particular, laminates and nets, and also films (for example, a polyolefin from the group of the polyethylenes (for example, HDPE, LDPE, MDPE, LLDPE, VLLDPE, copolymers of ethylene with polar comonomers) and/or the group of the polypropylenes (for example, polypropylene homopolymers, random polypropylene copolymers or block polypropylene copolymers), monoaxially or biaxially oriented polypropylene, polyesters, PVC, PET, polystyrene, polyamide or polyimide), foams, foam material, of polyethylene and polyurethane, for example, foamed films, and creped and uncreped paper. Moreover, these materials may have been given a pretreatment and/or an after treatment. Common pretreatments are corona irradiation, impregnation, coating, painting, and hydrophobicization; customary after treatments are calendering, thermal conditioning, lamination, die cutting, and enveloping.

Low flammability in the carrier material and in the adhesive tape as a whole may be achieved by adding flame retardants to the carrier and/or to the adhesive. These retardants may be organobromine compounds, together where appropriate with synergists such as antimony trioxide; however, with a view to the absence of halogens from the adhesive tape, preference will be given to using red phosphorus, organophosphorus compounds, mineral compounds or intumescent compounds such as ammonium polyphosphate, alone or in conjunction with synergists.

As adhesives it is possible to use substantially all known adhesives possessing sufficient bond strength to the bond substrate that is to be packed.

The adhesive of the adhesive tape may be composed of an adhesive based on solvent borne natural rubber adhesives and acrylic adhesives. Preference is given to adhesives based on acrylic dispersions; adhesives based on styrene-isoprene-styrene block copolymers are particularly preferred. These adhesive technologies are known and are used in the adhesive tape industry.

The coatweight of the adhesive on the carrier material is preferably from 15 to 60 g/m$^2$. In a further preferred embodiment, the coatweight set is from 20 to 30 g/m$^2$.

The adhesive tapes can be produced by known methods. An overview of customary production methods can be found, for example, in "coating equipment", Donatas Satas in Handbook of Pressure Sensitive Adhesive Technology, second edition, edited by Donatas Satas, Van Nostrand Reinhold New York pp. 767–808. The known methods of drying and cutting the adhesive tapes are likewise to be found in the Handbook of Pressure Sensitive Adhesive Technology, pp. 809–874.

A suitable adhesive composition is one based on acrylic hotmelt, having a K value of at least 20, in particular more than 30 (measured in each case in 1% strength by weight solution in toluene at 25° C.), obtainable by concentrating a solution of such a composition to give a system which can be processed as a hotmelt.

Concentrating may take place in appropriately equipped vessels or extruders; particularly in the case of accompanying devolatilization, a devolatilizing extruder is preferred. An adhesive of this kind is set out in DE 43 13 008 C2. In an intermediate step, the solvent is removed completely from the acrylate compositions prepared in this way.

The K value is determined in particular in analogy to DIN 53 726.

In addition, further volatile constituents are removed. After coating from the melt, these compositions contain only small fractions of volatile constituents. Accordingly, it is possible to adopt all of the monomers/formulations claimed in the above-cited patent. A further advantage of the compositions described in the patent is that they have a high K value and thus a high molecular weight. The skilled worker is aware that systems with higher molecular weights may be crosslinked more efficiently. Accordingly, there is a corresponding reduction in the fraction of volatile constituents.

The solution of the composition may contain from 5 to 80% by weight, in particular from 30 to 70% by weight, of solvent.

It is preferred to use commercially customary solvents, especially low-boiling hydrocarbons, ketones, alcohols and/or esters.

Preference is further given to using single-screw, twin-screw or multiscrew extruders having one or, in particular, two or more devolatilizing units.

The adhesive based on acrylic hotmelt may contain copolymerized benzoin derivatives, such as benzoin acrylate or benzoin methacrylate, for example, acrylates or methacrylates. Benzoin derivatives of this kind are described in EP 0 578 151 A.

The adhesive composition based on acrylic hotmelt may be UV-crosslinked. Other types of crosslinking, however, are also possible, an example being electron beam crosslinking.

In one particularly preferred embodiment, self-adhesive compositions used comprise copolymers of (meth)acrylic acid and esters thereof having from 1 to 25 carbon atoms, maleic, fumaric and/or itaconic acid and/or esters thereof, substituted (meth)acrylamides, maleic anhydride, and other vinyl compounds, such as vinyl esters, especially vinyl acetate, vinyl alcohols and/or vinyl ethers.

The residual solvent content should be below 1% by weight.

It is also possible to use an adhesive from the group of the natural rubbers or the synthetic rubbers or any desired blend of natural and/or synthetic rubbers, the natural rubber or rubbers being selectable in principle from all available grades such as, for example, crepe, RSS, ADS, TSR or CV grades, depending on required purity and viscosity, and the synthetic rubber or rubbers being selectable from the group of randomly copolymerized styrene-butadiene rubbers (SBR), butadiene rubbers (BR), synthetic polyisoprenes (IR), butyl rubbers (IIR), halogenated butyl rubbers (XIIR), acrylic rubbers (ACM), ethylene-vinyl acetate (EVA) copolymers and polyurethanes and/or blends thereof.

Furthermore, and preferably, the processing properties of the rubbers may be improved by adding to them thermoplastic elastomers with a weight fraction of from 10 to 50% by weight, based on the total elastomer fraction.

As representatives, mention may be made at this point, in particular, of the particularly compatible styrene-isoprene-styrene (SIS) and styrene-butadiene-styrene (SBS) types.

As tackifying resins it is possible without exception to use all known tackifier resins which have been described in the literature. Representatives that may be mentioned include the rosins, their disproportionated, hydrogenated, polymerized, esterified derivatives and salts, the aliphatic and aromatic hydrocarbon resins, terpene resins, and terpene-phenolic resins. Any desired combinations of these and other resins may be used in order to adjust the properties of the resulting adhesive in accordance with what is desired. Explicit reference is made to the depiction of the state of the art in the "Handbook of Pressure Sensitive Adhesive Technology" by Donatas Satas (van Nostrand, 1989).

"Hydrocarbon resin" is a collective term for thermoplastic polymers which are colorless to intense browning color and have a molar mass of generally <2000.

They may be divided into three main groups according to their provenance: petroleum resins, coal tar resins, and terpene resins. The most important coal tar resins are the coumarone-indene resins. The hydrocarbon resins are obtained by polymerizing the unsaturated compounds that can be isolated from the raw materials.

Included among the hydrocarbon resins are also polymers obtainable by polymerizing monomers such as styrene and/or by means of polycondensation (certain formaldehyde resins), with a correspondingly low molar mass. Hydrocarbon resins are products with a softening range that varies within wide limits from <0° C. (hydrocarbon resins liquid at 20° C.) to >200° C. and with a density of from about 0.9 to 1.2 g/cm$^3$ They are soluble in organic solvents such as ethers, esters, ketones, and chlorinated hydrocarbons, and are insoluble in alcohols and water.

By rosin is meant a natural resin which is recovered from the crude resin from conifers. Three types of rosin are differentiated: balsam resin, as a distillation residue of turpentine oil; root resin, as the extract from conifer root stocks; and tall resin, the distillation residue of tall oil. The most significant in terms of quantity is balsam resin.

Rosin is a brittle, transparent product with a color ranging from red to brown. It is insoluble in water but soluble in many organic solvents such as (chlorinated) aliphatic and aromatic hydrocarbons, esters, ethers, and ketones, and also in plant oils and mineral oils. The softening point of rosin is situated within the range from approximately 70 to 80° C.

Rosin is a mixture of about 90% resin acids and 10% neutral substances (fatty acid esters, terpene alcohols, and hydrocarbons). The principal rosin acids are unsaturated carboxylic acids of empirical formula $C_{20}H_{30}O_2$, abietic, neoabietic, levopimaric, pimaric, Isopimaric, and palustric acid, as well as hydrogenated and dehydrogenated abietic acid. The proportions of these acids vary depending on the provenance of the rosin.

Plasticizers which can be used are all plasticizing substances known from adhesive tape technology. They include, inter alia, the paraffinic and naphthenic oils, (functionalized) oligomers such as oligobutadienes and oligoisoprenes, liquid nitrile rubbers, liquid terpene resins, animal and vegetable oils and fats, phthalates, and functionalized acrylates.

For the purpose of heat-induced chemical crosslinking, it is possible to use all known heat-activatable chemical crosslinkers such as accelerated sulfur or sulfur donor systems, isocyanate systems, reactive melamine resins, formaldehyde resins, and (optionally halogenated) phenol-formaldehyde resins and/or reactive phenolic resin or diisocyanate crosslinking systems with the corresponding activators, epoxidized polyester resins and acrylic resins, and combinations thereof.

The crosslinkers are preferably activated at temperatures above 50° C., in particular at temperatures from 100° C. to 160° C., with very particular preference at temperatures from 110° C. to 140° C.

The thermal excitation of the crosslinkers may also be effected by means of IR rays or high-energy alternating fields.

The dispenser may be used with particular advantage in combination with a double-sided adhesive tape constructed as follows:

carrier coated on both sides with an adhesive (for example, acrylate, rubber, silicone) The carrier is composed preferably of paper, nonwoven, aluminum, films (for example, PP, PVC, polyester, PU).

single-side lining of paper and/or film, for example The liner preferably has an antiadhesive coating.

The dispenser designed in accordance with the invention is particularly advantageous for providing cardboard/plastic cores with strips of double-sided adhesive tape, the adhesive tape being applied in the longitudinal direction of the cores, especially for reel cutting and reel winding.

The dispenser designed in accordance with the invention is further advantageously suitable for providing paper reels or film reels with an adhesive tape for flying reel changeover (reel splice), the adhesive tape being applied in the longitudinal direction of the paper and/or film reels, especially in the context of the printing or finishing of papers and films.

Owing to its simple constructional design, the dispenser is suitable for being used without disruption in the automatic or semiautomatic application of sections of adhesive tape to sleeves or cores.

In this way, continuous operation is ensured, which is a requirement particularly of the papermaking industry.

One particularly advantageous embodiment of the dispenser of the invention is illustrated in more detail with reference to the figures described below, without wishing thereby to subject the invention to any unnecessary restriction.

BRIEF DESCRIPTION OF THE DRAWINGS

FIG. 1 shows the dispenser 1 for dispensing material 2 composed of a double-sidedly self-adhesive carrier material on a reel, in one particularly advantageous embodiment.

Figure 1:
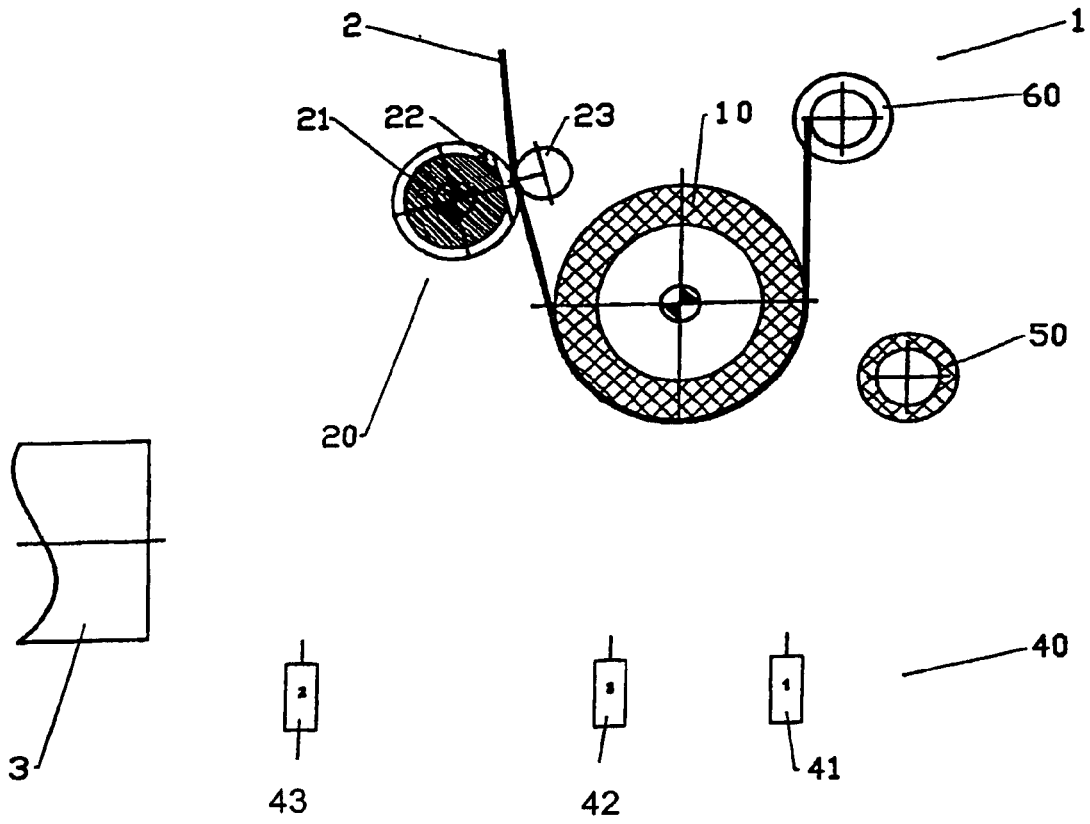
FIG. 1 shows the preparation of the adhesive tape in the particularly advantageously designed dispenser.

The dispenser 1 comprises essentially five assemblies:

The pressure roller 10, which during the dispensing operation presses the material 2 to be dispensed onto the product 3 running below the pressure roller 10 and otherwise is in a rest position above the product 3, has a coating of rubber on the outside. The pressure roller 10 has the material 2 looped around it at an angle of 180°.

The cutting means 20 by way of which the material 2 is guided in the direction of the pressure roller 10 which is arranged upstream of the pressure roller 10, and which weakens the material by means of an incision during the cutting operation.

The cutting means 20 is composed of a blade roller 21 and a counter roller 23, the blade roller 21 consisting of a roller on which there is a blade 22 in the longitudinal direction. The blade roller 21 is beveled at one side in such a way that the material 2 can be guided between blade roller 21 and counter roller 23 without contact when the blade roller 21 is in the rest position.

The means 40 for recognizing the position of the product 3 guided to the dispenser 1 comprises a) a start contact 41 which, when the product 3 is passed in front of it, triggers the dispensing operation of the dispenser 1, so that the pressure roller 10 is guided from the rest position into the dispensing position, b) an end contact 42 which, when the product 3 is passed in front of it, ends the dispensing operation of the dispenser 1, so that the pressure roller 10 is guided out of the dispensing position into the rest position, and c) a blade contact 43 which, when the product 3 is passed in front of it, initiates the cutting operation of the cutting means 20.

Further present in the dispenser 1 downstream of the pressure roller 10 is a fixing roller 50, which presses the dispensed material 2 onto the product 3, the fixing roller 50 being adapted to the surface form of the product 3.

Since the dispenser 1 is used here in conjunction with a double-sided adhesive tape 2 lined on one side with a continuous release paper, downstream of the pressure roller 10 there is a storage roller 60 which winds up the release paper of the dispensed material 2.

FIG. 1 shows the dispenser 1 set up for further continuous operation. The adhesive tape 2 at this point has no incision, so that first of all when operation of the dispenser 1 is commenced it is not just the release paper which is wound onto the storage roller 60 but the entire adhesive tape 2.

A closed series of individual cores 3 is guided into the dispenser 1 (in FIG. 1, they are coming from the left, with only the first core 3 being shown here).

Figure 2:
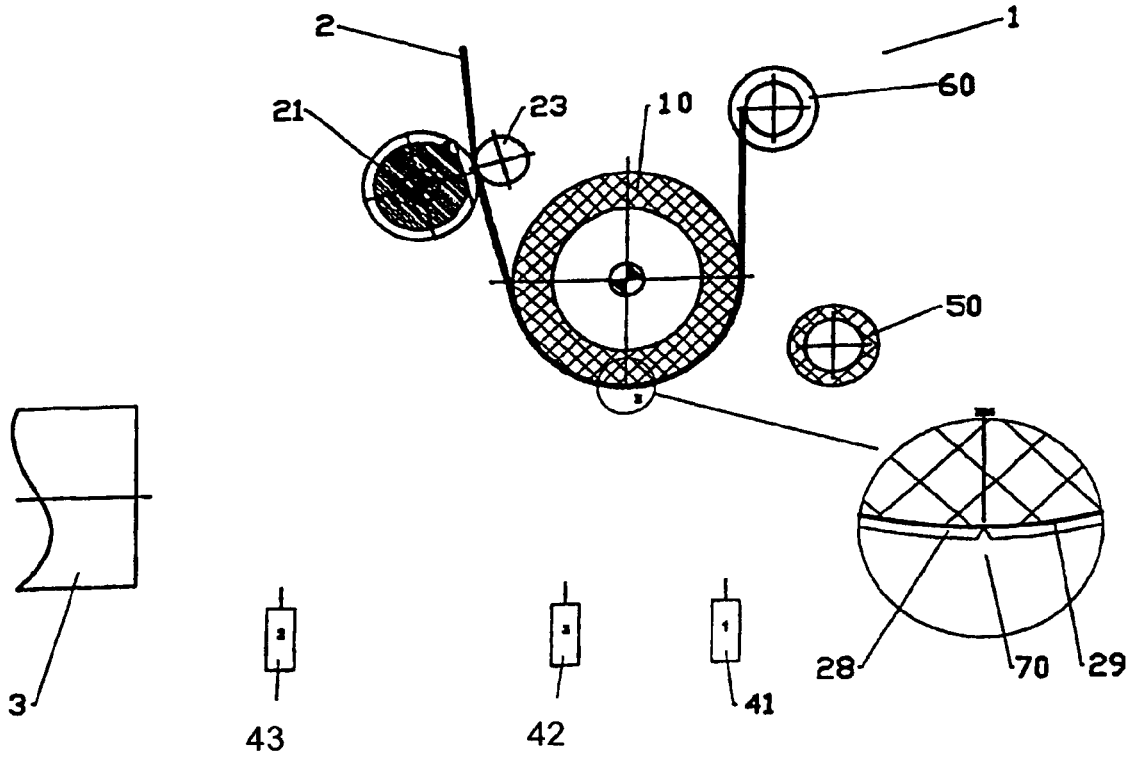
FIG. 2 shows the incipiently cut adhesive tape brought into the start position.

FIG. 2 shows the incipiently cut adhesive tape 2 brought into the start position. For this purpose the actual adhesive tape 28 is severed by the blade roller 21, through to the release paper 29 (see enlarged section in FIG. 2). The blade roller 21 rotates until the blade 22 coincides with the counter roller 23. Since the gap between blade 22 and counterpressure roller 23 is then very small, the adhesive tape 2 is separated. The gap is chosen, however, so that the release paper 29 is not cut.

After cutting, the intact release paper 29 is able to convey the severed adhesive tape 28 onward until the incision 70 lies exactly below the pressure roller 10. The dispenser 1 has thus been prepared so that the first core 3 can be guided into the dispenser 1.

Figure 3:
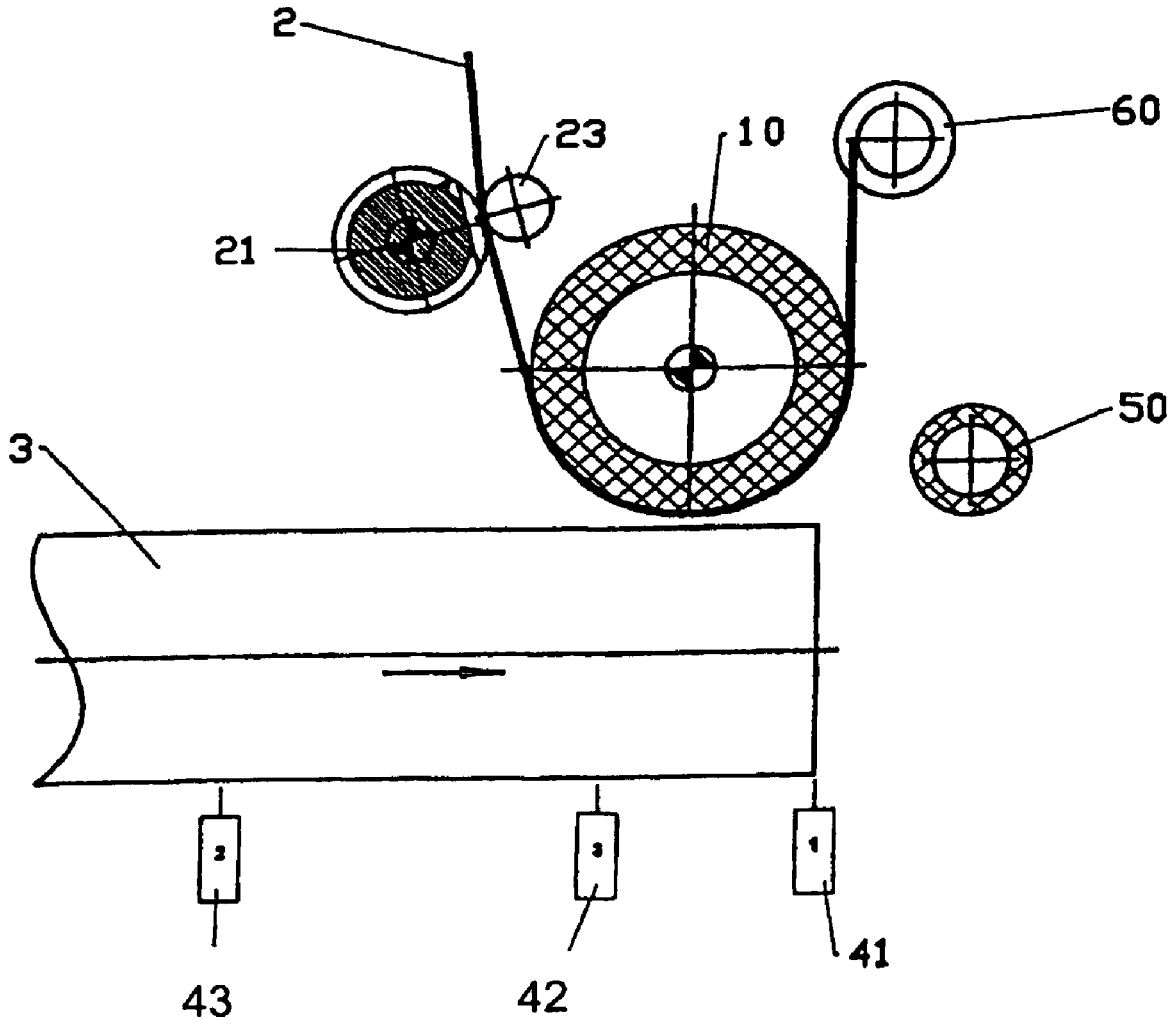
FIG. 3 shows the core of a subsequent paper reel to be provided with the adhesive tape section, in the start position.
Figure 4:
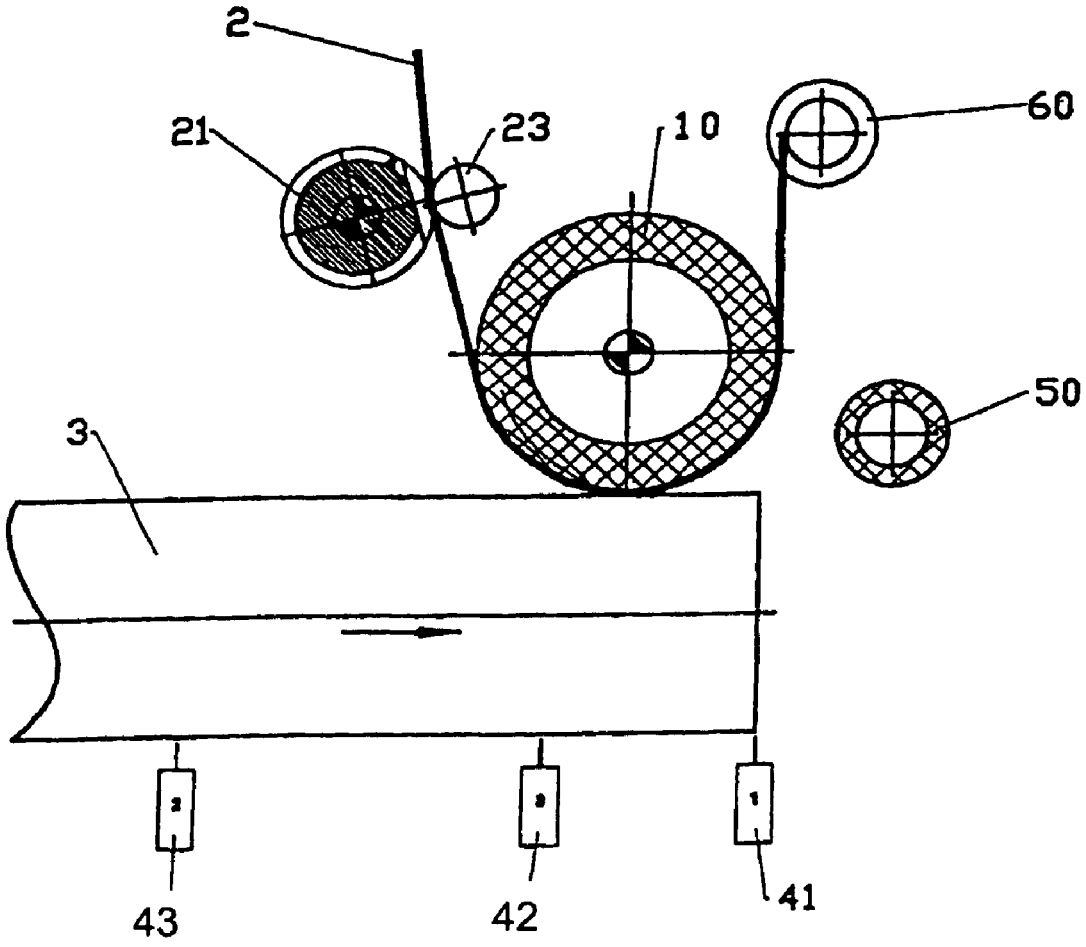
FIG. 4 shows the pressure roller which, when the start position is reached, is lowered onto the product by the core, thereby setting in motion the operation of dispensing the adhesive tape.

FIGS. 3 and 4 represent the core 3 of a subsequent reel of paper, the said core being intended for provision with the adhesive tape section 2, in the start position.

At the moment when the core reaches the start contact 41 of the means 40 for recognizing the position of the product 3 guided to the dispenser 1, the dispensing operation of the dispenser 1 is initiated. The pressure roller 10 is lowered from the rest position into the dispensing position, so that the adhesive tape 2 comes into contact with the core 3. The beginning of the adhesive tape 2 is pressed on the product 3.

If, then, the core 3 is conveyed further into the dispenser 1, the dispenser 1 begins to rotate synchronously to the speed of the core 3, so that the peripheral speed of the adhesive tape 2 on the pressure roller 10 corresponds approximately to the rate of advance of the core 3.

Figure 5:
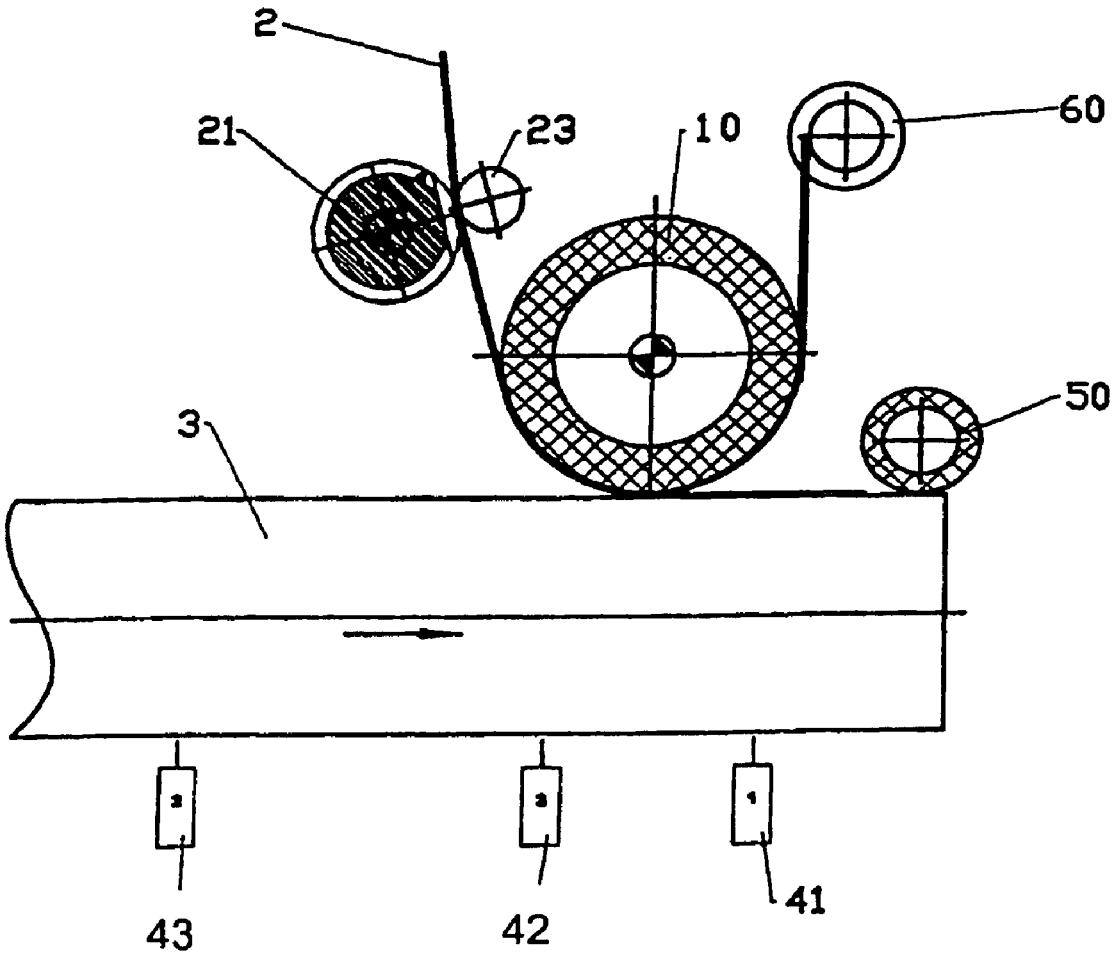
FIG. 5 shows the pressure roller lowered onto the product, during the dispensing operation.

FIG. 5 shows the actual operation of application. The pressure roller 10, lowered onto the product 3, dispenses the strip of adhesive tape 2 onto the product 3 in the dispensing operation.

At the same time, the release paper 29 separated from the adhesive tape 2 is wound up onto the storage roller 60. The blade roller 21 is in the rest position.

Figure 6:
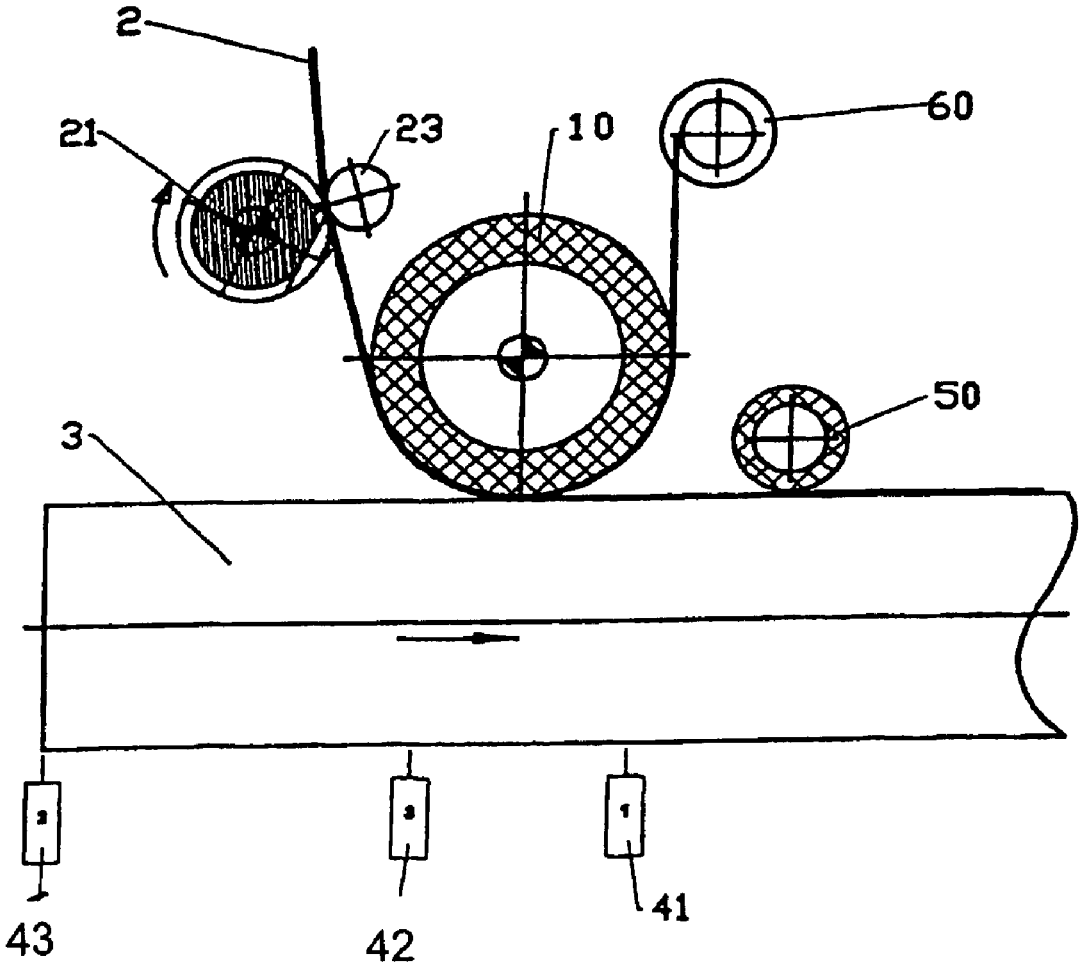
FIG. 6 shows the cutting of the adhesive tape in the cutting means, in order to prepare the next adhesive tape section.

In FIG. 6, the end of the core 3 reaches the blade contact 43, which, when the product 3 is passed in front of it, initiates the cutting operation of the cutting means 20 into the adhesive tape 2 in order to prepare the next adhesive tape section 2.

For this purpose the blade 22 of the blade roller 21 is rotated in the same direction as the adhesive tape 2 until the blade 22 coincides with the counter roller 23. The adhesive tape 2 is again severed up to the release paper 29.

On the other side, the fixing roller 50 present downstream of the pressure roller 10 ensures that the dispensed material 2 is pressed on the product 3.

Figure 7:
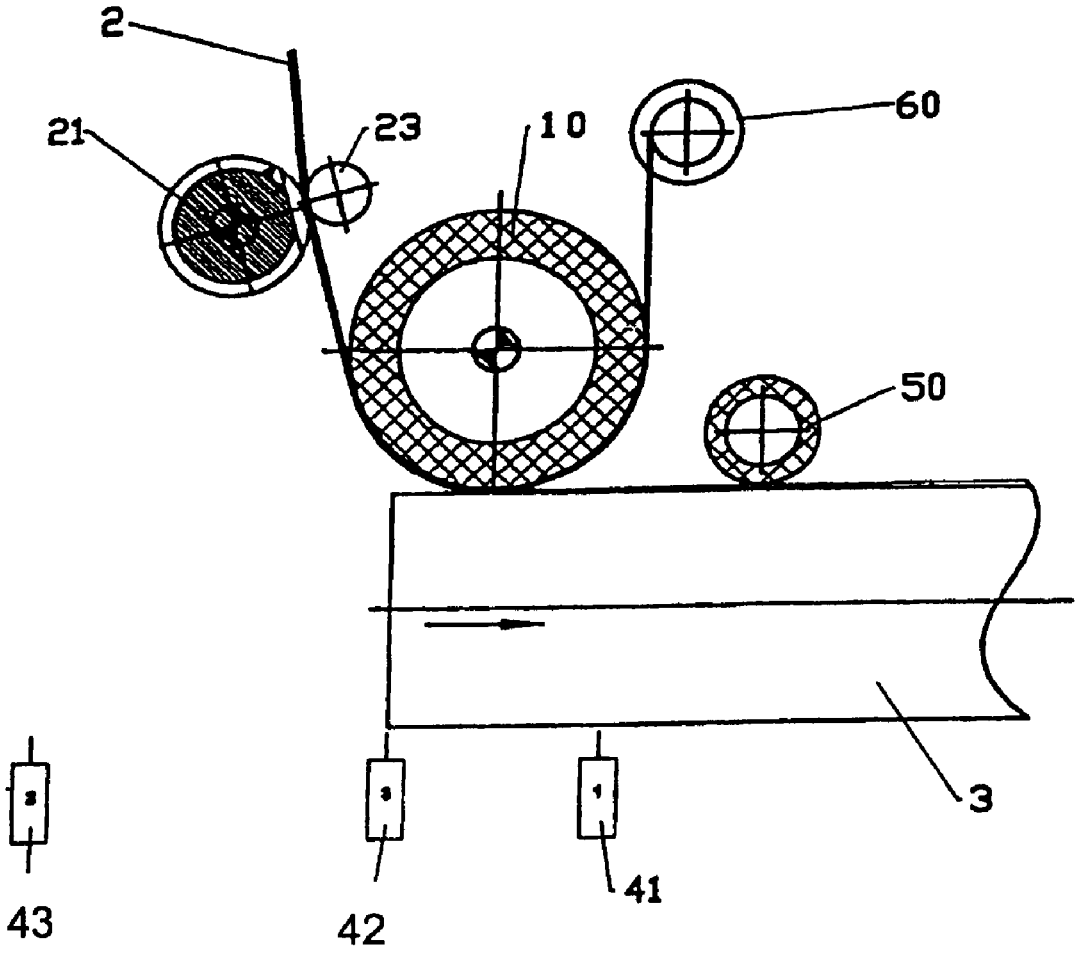
FIG. 7 shows the core of a subsequent reel of paper, intended for provision with the adhesive tape section, in the end position.
Figure 8:
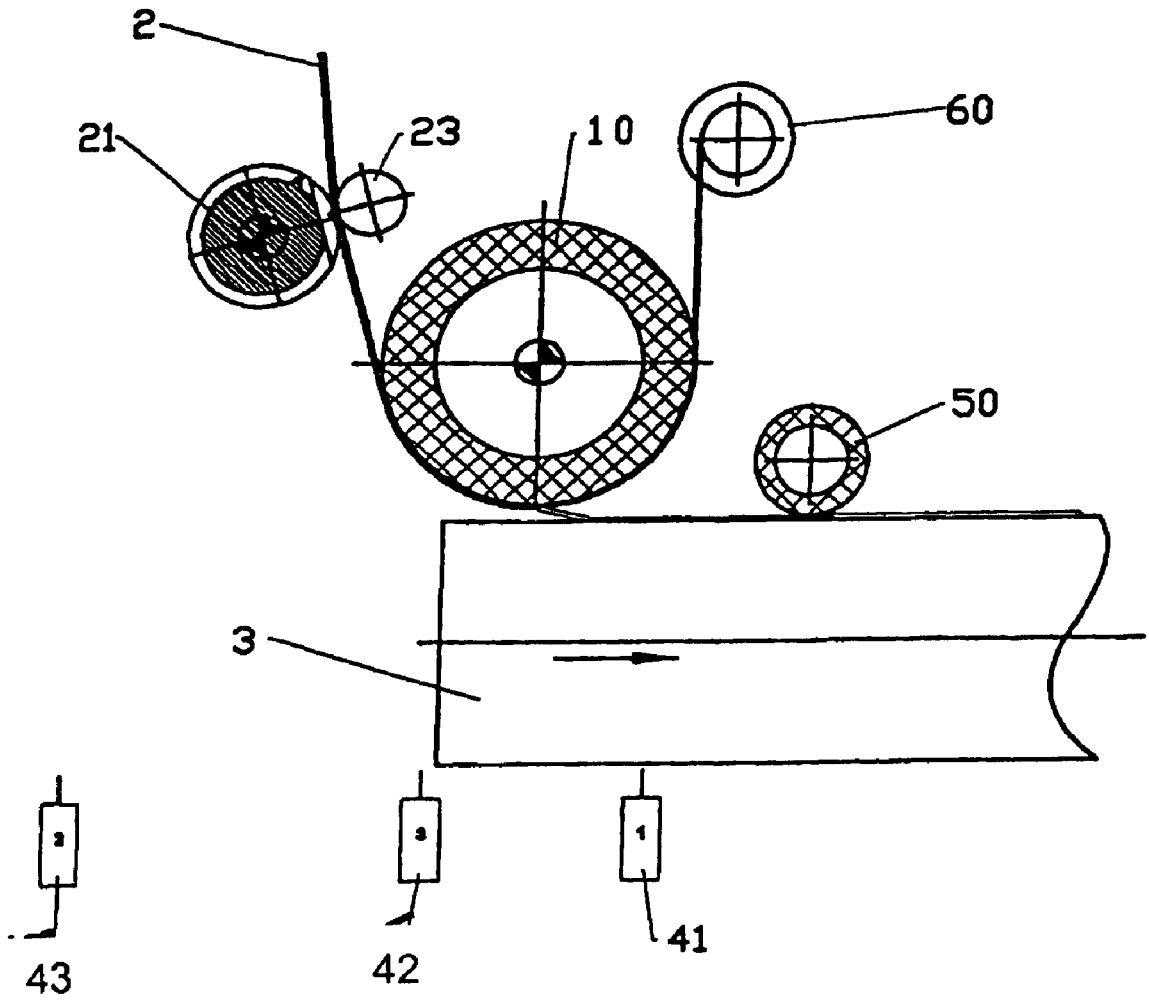
FIG. 8 shows the pressure roller which, when the start position is reached, is raised from the product by the core, thereby ending the operation of dispensing the adhesive tape.

In FIGS. 7 and 8 the end of the core 3 reaches the end contact 42, which, when the product 3 is passed in front of it, ends the dispensing operation of the dispenser 1, so that the pressure roller 10 is guided out of the dispensing position into the rest position, thereby ending the operation of dispensing the adhesive tape 2.

The dispenser 1 stands still in this position, and thus does not continue to rotate. Since the product 3 is simultaneously conveyed out of the dispenser 1, the increasing tension causes the adhesive tape section to separate from the adhesive tape 2 at the cut made previously.

Accordingly, the product 3 has been provided over the desired length with a strip of an adhesive tape 2.

Not shown here, immediately after the core 3 provided with a strip of the adhesive tape 2 has departed the dispenser 1, another core 3 is moved into the dispenser 1, so providing the state depicted in FIGS. 3 and 4. The dispensing operation begins anew.

We claim:

1. A dispenser for dispensing a material comprised of a double-sidedly self-adhesive carrier, having a release paper covering the adhesive on one side, on a reel, which comprises a press, which during a dispensing operation presses the material to be dispensed onto a product having a first end and a second, which is in continuous movement relative to the dispenser, and is otherwise in a rest position, a cutter by which the material is guided in the direction of the press, said cutter being arranged upstream of the press, and weakens the material by making an incision which severs the double-sided self-adhesive carrier through to the release paper in a culling operation, and a controller comprising at least a) a start contact which, when the first end of the product is passed in front of it, initiates the dispensing operation so that the press is guided out of the rest position into the dispensing position, b) an end contact which, when the second end of the product is passed in front of it, terminates the dispensing operation, so that the press is guided out of the dispensing position into the rest position, and optionally, c) a blade contact which, when the second end of the product is passed in front of it, initiates the culling operation whereby the length of said material applied to said product is determined by the length of said product.

2. The dispenser as claimed in claim 1, wherein the cutter is comprised of a blade roller and a counter roller, the blade roller consisting of a roller on which there is at least one blade.

3. The dispenser as claimed in claim 1, wherein downstream of the press, there is a second press selected from the group consisting of a fixing roller, brush or plate, which presses the dispensed material on the product.

4. The dispenser as claimed in claim 1, wherein downstream of the press, there is a storage roller which, for applications which, when said material comprises a release paper, winds up release paper separated from the dispensed material.

5. A method for providing cardboard or plastic cores with strips of double-sided adhesive tape, which comprises applying said adhesive tape to the cores, in the longitudinal direction of the cores, with the dispenser of claim 1.

6. A method for providing reels of paper or film with an adhesive tape for flying reel changeover, which comprises applying said adhesive tape to said reels of paper or film, in the longitudinal direction of the reels of paper or film, with the dispenser of claim 1.

7. The dispenser of claim 1, wherein said press is a pressure roller, a brush or a plate.

8. The dispenser of claim 7, wherein said press is a pressure roller.

9. The dispenser of claim 1, comprising said optional blade contact, wherein said blade contact is integrated in the start contact or the end contact.

10. The dispenser of claim 1, wherein said cutter is comprised of a blade roller and a counter roller.

11. The dispenser of claim 1, wherein said cutter is a punch or a punching line.

12. The dispenser of claim 3, wherein said second press is a fixing roller, and said fixing roller is adapted to the surface form of the product.

* * * * *